US010694913B2

(12) United States Patent
Erkek et al.

(10) Patent No.: US 10,694,913 B2
(45) Date of Patent: Jun. 30, 2020

(54) METHOD FOR OPERATING AN AUTOMATICALLY MOVING FLOOR PROCESSING DEVICE

(71) Applicant: Vorwerk & Co. Interholding GmbH, Wuppertal (DE)

(72) Inventors: David Erkek, Aarau (CH); Georg Hackert, Bochum (DE); Gerhard Isenberg, Cologne (DE); Roman Ortmann, Huerth (DE); Andreas Schmidt, Mettmann (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 0 days.

(21) Appl. No.: 16/001,346

(22) Filed: Jun. 6, 2018

(65) Prior Publication Data

US 2018/0353043 A1 Dec. 13, 2018

(30) Foreign Application Priority Data

Jun. 9, 2017 (DE) ..... 10 2017 112 794

(51) Int. Cl.

| | |
|---|---|
| ***A47L 11/40*** | (2006.01) |
| ***A47L 7/00*** | (2006.01) |
| ***A47L 7/02*** | (2006.01) |

(52) U.S. Cl.

CPC ..... *A47L 11/4011* (2013.01); *A47L 7/009* (2013.01); *A47L 7/0085* (2013.01); *A47L 7/02* (2013.01); *A47L 11/4055* (2013.01); *A47L 2201/00* (2013.01); *A47L 2201/06* (2013.01)

(58) Field of Classification Search

CPC ..... A47L 11/4011; A47L 11/4055; A47L 2201/00; A47L 2201/06; A47L 7/0085; A47L 7/009; A47L 7/02

See application file for complete search history.

(56) References Cited

U.S. PATENT DOCUMENTS

| | | | | |
|---|---|---|---|---|
| 8,364,309 B1 * | 1/2013 | Bailey | ..... | G06N 3/008 700/245 |
| 2012/0125363 A1 * | 5/2012 | Kim | ..... | A47L 9/28 134/6 |

FOREIGN PATENT DOCUMENTS

| | | | | |
|---|---|---|---|---|
| DE | 10 2008 014 912 A1 | 9/2009 | | |
| DE | 10 2011 000 536 A1 | 8/2012 | | |
| DE | 10 2015 113 035 A1 | 2/2017 | | |
| DE | 102016124901 A1 * | 6/2018 | ..... | A47L 9/2894 |
| JP | 2004-174149 A | 6/2004 | | |
| JP | 2004174149 A * | 6/2004 | | |

OTHER PUBLICATIONS

Machine translation of DE102016124901A1 (Year: 2018).*

* cited by examiner

*Primary Examiner* — Douglas Lee

(74) *Attorney, Agent, or Firm* — Collard & Roe, P.C.

(57) ABSTRACT

A method for operating a floor processing device that moves automatically within an environment, has a detection system of the floor processing device that detects features of a surface to be cleaned and compares them with reference features of carpets. Upon detection of a carpet, it is determined whether and where the carpet has fringes, and the fringes are aligned in a defined direction relative to the carpet by means of a combing attachment of the floor processing device.

9 Claims, 5 Drawing Sheets

METHOD FOR OPERATING AN AUTOMATICALLY MOVING FLOOR PROCESSING DEVICE

CROSS REFERENCE TO RELATED APPLICATIONS

Applicant claims priority under 35 U.S.C. § 119 of German Application No. 10 2017 112 794.1 filed Jun. 9, 2017, the disclosure of which is incorporated by reference.

BACKGROUND OF THE INVENTION

1. Field of the Invention

The invention relates to a method for operating a floor processing device that moves automatically within an environment, wherein a detection system of the floor processing device detects features of a surface to be cleaned and compares them with reference features of carpets.

The invention further relates to a floor processing device that moves automatically within an environment with a housing and a detection system, which is set up to detect features of a surface to be cleaned and compare them with reference features of carpets.

2. Description of the Related Art

Floor processing devices of the aforementioned kind and methods for their operation are known in the art.

For example, the floor processing device can be a cleaning robot, which can independently perform a vacuuming job.

For example, publications DE 10 2011 000 536 A1 and DE 10 2009 014 912 A1 disclose such methods in conjunction with automatically movable vacuuming and/or cleaning robots for cleaning floors. The robots are equipped with distance sensors, which measure distances to obstacles, such as pieces of furniture or room boundaries. An area map is generated from the measured distance data, based upon which a travel route that avoids collisions with obstacles can be planned. The distance sensors preferably operate without contact, for example using light and/or ultrasound. It is further known to provide the robot with means for performing an all-around distance measurement, for example with an optical triangulation system arranged on a platform that rotates around a vertical axis or the like. The acquired distance data are processed into an area map by a calculating means of the robot and stored, so that this area map can be accessed during an operation for orientation purposes.

Published patent application JP 2004174149 A further discloses a vacuuming robot and a method for its operation, wherein a camera of the vacuuming robot identifies an edge of a carpet and detects whether this edge has fringes. If the carpet has fringes, a brush of the vacuuming robot is deactivated, so that the edge can be traversed without any problems, and the fringes do not get sucked into the vacuuming robot.

SUMMARY OF THE INVENTION

Proceeding from the aforementioned prior art, the object of the invention is to indicate a floor cleaning device and a method for operating a floor cleaning device in which the fringes of a carpet are detected and processed.

As opposed to known wall-to-wall carpets that cover the floor of a room, a carpet usually has a smaller surface area. Within the meaning of the invention, carpets are movably arranged on a floor of the room, and typically have thicknesses of 5 mm up to 30 mm or more. Within the meaning of the invention, fringes are threads that usually extend outwardly parallel to a large surface plane of the carpet. These can arise due to tears or cuts at the edges of the carpet, or when long protruding warp threads become knotted into groups. In a usually desired orientation, the fringes extend perpendicularly outward in relation to the carpet edge, and lie next to the carpet on a floor.

In order to achieve the aforementioned object, a method is proposed in which, upon detection of a carpet, it is determined whether and where the carpet has fringes, wherein the fringes are aligned in a defined direction relative to the carpet by means of a combing attachment of the floor processing device.

Contrary to known prior art, in which a brush or some other processing attachment of the floor processing device is turned off to traverse a carpet with fringes, the latter is now advantageously used as a combing attachment to align the fringes of the carpet, and thereby possibly even clean them. The floor processing device and/or the combing attachment of the floor processing device are controlled by means of a controller of the floor processing device in such a way as to align the fringes in a defined direction relative to the carpet. This defined direction is usually a direction oriented perpendicular to a closing edge of the carpet. In addition, the fringes are usually aligned parallel to each other. The combing attachment especially preferably combs the fringes perpendicularly outward relative to the respective carpet edge.

A carpet can be detected during a floor processing operation of the floor processing device according to various methods of floor detection. For example, a camera of the floor processing device records an image and/or a video of the environment, and relays it to the calculating means. The calculating means executes an image processing program, which detects defined features within the image or video and compares them with reference features that usually characterize the carpets. For example, these features can be a surface occupied in the environment, a height relative to a floor surface and/or a structure or color. Additional features are also possible, of course. In addition, a position of the carpet in a room of a home or relative to pieces of furniture can also help in making the determination. As an alternative or in addition to the camera, the detection system can further also have other optical sensors, ultrasound sensors, contact sensors and the like. Whether the carpet has fringes is basically detected in the usual manner through comparison with stored reference features. Reference features for fringes can include a specific length, width and height, a number, a current orientation relative to the carpet and the like, for example. If it is ultimately determined that the carpet has fringes, the combing attachment will be used according to a predefined strategy to align the fringes.

Before processing the fringes of a carpet, it is proposed that the floor processing device initially process an area of the environment and/or carpet that has no fringes. As a consequence, those areas in which no fringes were detected are preferably processed first. Initially avoiding the fringe areas makes it possible to avoid malfunctions of the floor processing device, which may arise if the floor processing device constantly changes from fringe areas to non-fringe areas and vice versa. After the fringe-free areas have been processed, areas of the carpet having the fringes are processed, wherein the fringes are specifically aligned and if necessary cleaned.

It is proposed that a travel strategy and/or travel route of the floor processing device be generated depending on a detected position and/or a desired orientation of the fringes on the carpet. The positions and extensions of carpets detected by the detection system are drawn upon to plan a travel strategy and/or travel route for the floor processing device through the environment. As explained above, the travel route or travel strategy can involve initially cleaning those areas of the environment or carpet that have no fringes. In addition, the travel strategy or travel route can also be planned so that a specific travel direction of the floor processing device results in a desired alignment of fringes, because the combing attachment then is oriented accordingly relative to a carpet and pulled through the fringes. An alignment with parallel fringes perpendicular to an accompanying edge area of the carpet preferably comes about. For example, the floor processing device can exit the carpet section by section via adjacent partial edge areas, so that the fringes can become aligned parallel to each other, and the fringes can become aligned perpendicular relative to the respective edge area of the carpet. In addition, the travel strategy and/or travel route can involve approaching several carpets present in the environment in a specific sequence, from a specific direction or the like. Furthermore, the travel strategy can provide for the use of specific floor processing elements in specific partial areas of the environment, for example floor processing elements on a carpet that are different than in a fringe area or a completely uncarpeted area of the environment.

It is especially preferred that a position and orientation of a detected carpet and a position and/or orientation of the fringes be stored in an area map of the floor processing device. The area map of the floor processing device can further contain objects and room boundaries in the usual manner, for example pieces of furniture and walls of a home. In addition, carpets are also stored in the area map as proposed, specifically their position and orientation within the respective room. In addition, the area map also contains information about which edge areas of the carpet have fringes, and in which direction in space or in which direction relative to the carpet these are oriented. Based on the area map generated in this way, a travel strategy or travel route can then be planned for the floor processing device. Planning can subsequently take place according to specific criteria, as explained above, for example to initially clean areas with no carpets or fringes, approach several carpets in a specific sequence, and so on.

It is further proposed for aligning the fringes that the floor processing device travel onto the carpet and leave it in a direction corresponding to a desired orientation of the fringes. This is achieved by orienting the wheels or the floor processing device and/or combing attachment in such a way as to align their contact surface parallel to the desired orientation of the fringes. This is preferably an unrolling or combing direction oriented perpendicular to an edge area of the carpet. For example, if the combing attachment is a comb with parallel teeth or a brush with a plurality of bristles, the fringes can be optimally aligned. A travel strategy for the floor processing device advantageously involves the floor processing device moving outwardly over the fringes section by section, for example proceeding from a central area, specifically perpendicular to an allocated edge of the carpet. After moving over the fringes, the floor processing device can again travel on the carpet, for example, preferably from a side where the fringes have not yet been aligned.

In particular, it is proposed that the floor processing device travel over an edge area of the carpet having no fringes. This embodiment is suitable for carpets that have at least one edge area bearing no fringes. For example, this can be a carpet which has fringes on two mutually parallel edge areas, and has no fringes on two other mutually parallel edge areas, in particular ones that are perpendicular to the two aforementioned edge areas. In this embodiment, the floor processing device, after aligning the fringes and moving off the carpet, can again move onto the carpet that has no fringes. This can be followed by a renewed alignment of fringes, in particular in an adjacent edge area.

In addition, it is proposed that the fringes be combed by means of a bristle roller of the floor processing device. In particular, the fringes can be combed by means of a bristle roller that rotates around a rotational axis aligned essentially parallel to the carpet during a floor processing operation. The bristle roller combing the fringes can basically rotate around a rotational axis aligned either parallel or perpendicular to the carpet. However, in particular a bristle roller that rotates around a rotational axis aligned parallel to the carpet is suitable for aligning the fringes parallel to each other and perpendicular to an edge area of the carpet. At the same time, the bristle roller combing the fringes is especially preferably suitable for cleaning a surface to be cleaned in the environment during a processing operation of the floor processing device. Such a bristle roller usually has a very wide variety of bristles arranged one next to and behind the other, for example which achieve an improved cleaning effect on carpets and wall-to-wall carpeting during a vacuum operation of the floor processing device. As a consequence, such a bristle roller can handle both cleaning jobs and combing jobs.

It can further be provided that a speed and/or rotational direction of the bristle roller be varied for combing and/or traversing the fringes. Depending on the composition of the fringes to be aligned, the bristle roller can thus rotate faster or slower by comparison to a speed during a conventional floor cleaning operation of the floor cleaning device. A motor or transmission of the floor processing device is advantageously suitable for generating various speeds and/or rotational directions of the bristle roller. It is usually advantageous that the bristle roller be rotated at a slower speed for aligning the fringes than when cleaning the floor. In addition, it can also be advantageous that the rotational direction of the bristle roller be set as a function of whether the floor processing device is currently moving down off of the carpet or moving up onto the carpet. The rotational direction of the bristle roller should correspond to the respective combing direction of the fringes, so as to achieve or maintain the desired alignment of the fringes. It can further also be provided that the bristle roller not be rotated at all when traversing already combed fringes. This embodiment can be advantageous in particular where the rotational direction of the bristle roller cannot be changed. This prevents the aligned fringes from again becoming tangled up with each other.

It can further be provided that a floor processing element of the floor processing device be lifted from the surface while traversing the fringes. In particular, it can be provided that the combing attachment be lifted from the surface when traversing already aligned fringes. For example, the floor processing element can be a side brush of a floor processing device, an additional wiping element or the like. As soon as the detection system of the floor processing device has detected that fringes are currently being or will soon be traversed, these floor processing elements, which do not serve to align the fringes, can be completely lifted from the surface, so as not to disrupt the alignment of fringes or tangle up already aligned fringes.

Aside from the method described above for operating a floor processing device that moves automatically within an environment, the invention further proposes a floor processing device that moves automatically within an environment with a housing and a detection system, wherein the detection system is set up to detect features of a surface to be cleaned and compare them with reference features of carpets, wherein the floor processing device has a combing attachment for aligning fringes of a carpet in a defined direction, wherein the combing attachment is arranged on the floor processing device so that it can be displaced relative to the fringes and housing and/or controlled in relation to a speed and/or rotational direction around a rotational axis. For example, the combing attachment can be a floor processing element already arranged on the floor processing device for performing floor processing jobs, for example a bristle roller that can rotate around a horizontal rotational axis (relative to an orientation during a conventional floor processing operation) or the like. As an alternative, the combing attachment can also be provided on the floor processing device exclusively for purposes of aligning carpet fringes. The combing attachment can preferably interact with a controller of the floor processing device, which can control a displacement and/or rotation of the combing attachment relative to a housing of the floor processing device. In particular, a speed and/or rotational direction of a rotating combing attachment can also be controlled. The floor processing device as a whole is thus configured to align fringes of a carpet according to an embodiment variant of the method described above. All features and advantages described above in relation to the method also apply accordingly to an embodiment of the floor processing device according to the invention.

In particular, it is proposed that the floor processing device have a combing attachment that can be extended from the housing of the floor processing device. As a consequence, the combing attachment can be extended from the housing when needed, and otherwise be compactly held inside the floor processing device, so as not to increase the dimensions of the floor processing device. The combing attachment can preferably be a non-rotating brush that can be displaced relative to the fringes and/or relative to the housing of the floor processing device. In order to align the fringes outside of the carpet, this embodiment allows the floor processing device to move next to a respective edge area, and the combing attachment to align the fringes in constantly repeating combing motions. This embodiment simplifies navigation of the floor processing device, since the floor processing device does not always have to enter and then exit the carpet again.

BRIEF DESCRIPTION OF THE DRAWINGS

The invention will be explained in more detail below based on exemplary embodiments. In the drawings.

DETAILED DESCRIPTION OF THE PREFERRED EMBODIMENTS

Figure 1:
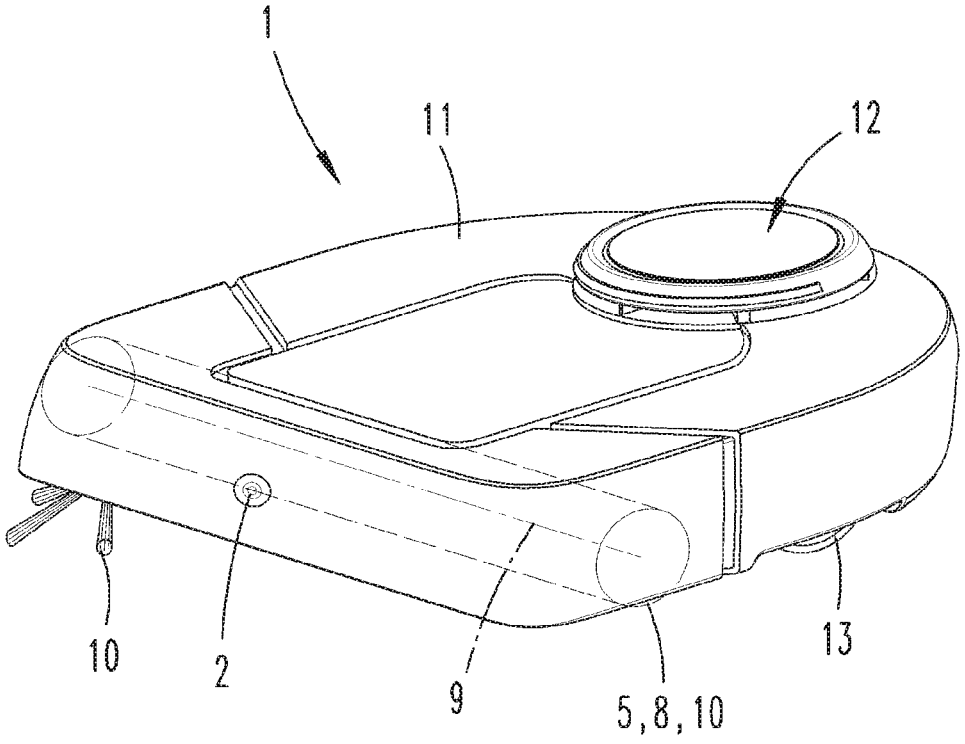
FIG. 1 is a perspective view of a floor processing device.

FIG. 1 shows a floor processing device 1, which here is designed as a vacuuming robot. The floor processing device 1 has motor-driven wheels 13, which the floor processing device 1 can use to move within an environment. In addition, the floor processing device 1 has floor processing elements 10, here specifically a side brush laterally protruding over the housing 11 of the floor processing device 1 as well as a bristle roller 8, which can be rotated around a rotational axis 9. The rotational axis 9 is horizontally oriented in the usual operational position of the floor processing device 1 depicted here, meaning essentially parallel to a surface to be cleaned. The bristle roller 8 is used on the one hand to loosen dirt from the surface to be cleaned, in particular from a carpet 5, and on the other as a comb attachment for aligning fringes 4 of a carpet 3. This has yet to be touched upon below.

The floor processing device 1 further has a distance measuring system 12, which here has a triangulation measuring system, for example. The distance measuring system 12 is arranged within the housing 11 of the floor processing device 1, and specifically has a laser diode, the emitted light beam of which is guided out of the housing 11 by a diverter, and can be rotated around a rotational axis that is perpendicular in the depicted orientation of the floor processing device 1, in particular with a measuring angle of 360°. This enables a panoramic distance measurement around the floor processing device 1. The distance measuring system 12 measures distances from obstacles, for example pieces of furniture 17, within an environment of the floor processing device 1.

In the area of the floor processing elements 10, the floor processing device 1 further has a suction nozzle opening (not shown in any greater detail), through which air loaded with suction material can be vacuumed into the floor processing device 1 by means of a motor-fan unit. The floor processing device 1 has a rechargeable battery (not shown) for supplying power to the individual electric components of the floor processing device 1, as well as for driving the wheels 13 and floor processing elements 10 and any other electronics provided.

The floor processing device 1 also has a detection system 2, here specifically a camera arranged at the front of the housing 11 in the travel direction of the floor processing device 1, which records images of the environment. The detection system 2 is connected with an evaluator and controller of the floor processing device 1 (not shown), so that images recorded by the detection system 2 can be evaluated. Evaluation involves comparing the features of a surface to be cleaned present in the image with reference features of carpets 3 or fringes 4, so that carpets 3 having fringes 4 can be found within the environment. The reference features are stored in a memory of the floor processing device 1, and consist of typical features of carpets 3 or fringes 4, specifically for example a height, width and length, a structure, an orientation, and the like.

Figure 2:
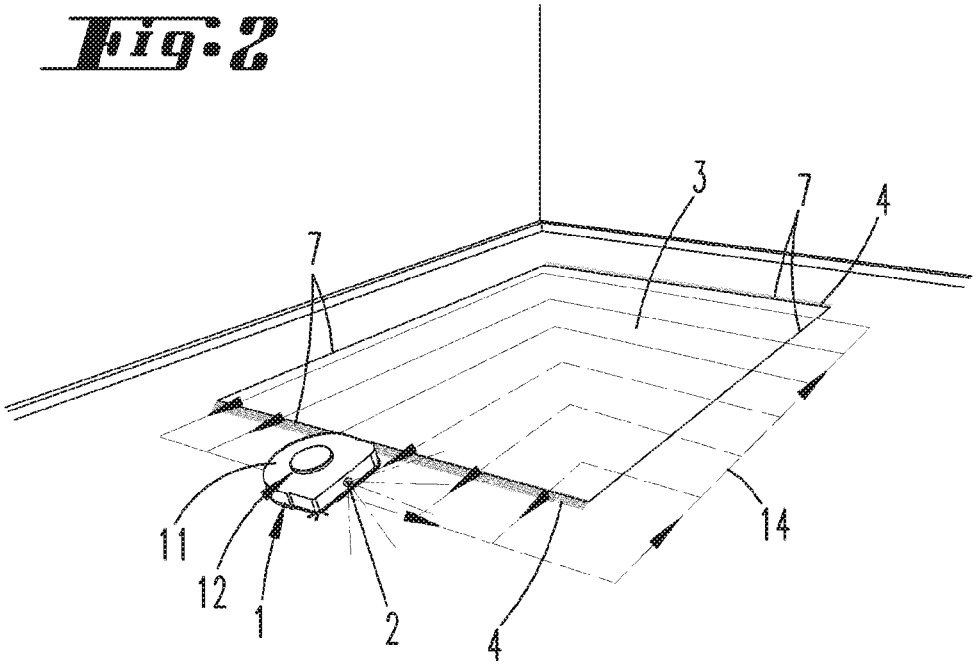
FIG. 2 is a floor processing device following a travel route on a carpet.

FIG. 2 shows a partial area of an environment, specifically a room of a home which has a carpet 3 with fringes 4. A floor processing device 1 travels next to the carpet 3 along an edge region 7 of the carpet 3 having fringes 4. Further depicted is a travel route 14 taken by the floor processing device 1 for cleaning the carpet 3 and aligning the fringes 4. The travel route 14 involves having the floor processing element 10 traverse the carpet 3 section by section and align the fringes 4 section by section. As evident, the travel route 14 involves having the floor processing device 1 move over an edge area 7 having no fringes 4 and onto the carpet 3, and then swivel by 90° to again exit the carpet 3 perpendicular to an edge area 7 having fringes. While traversing the fringes 4, the rotational axis 9 of the bristle roller 8 is oriented parallel to the edge area 7, so that the rotational direction of the bristle roller 8 corresponds to the desired alignment of the fringes 4. As a result, the desired alignment comes about while traversing the fringes 4 and having the bristle roller 8 simultaneously rotate in a nap direction of the fringes 4. As soon as the floor processing device 1 has again left the carpet 3 and fringes 4, it again moves along the edge area 7 to a side of the carpet 3 having no fringes 4, so as to move up onto the carpet 3 once more and align fringes 4 on another, adjacent edge area 7.

Figure 3:
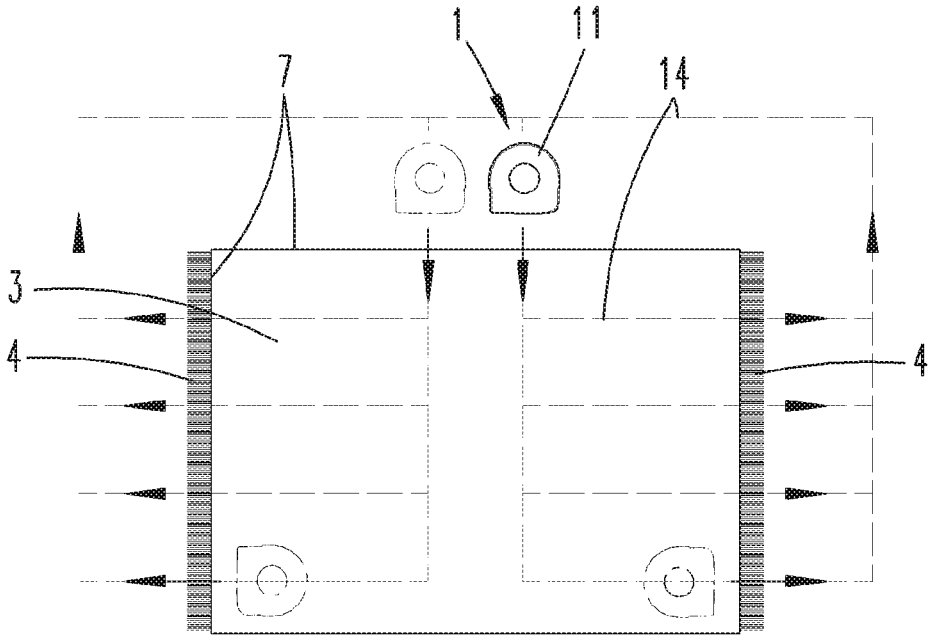
FIG. 3 is a sketch of a travel route of the floor processing device.

FIG. 3 shows a travel route 14 for cleaning the carpet 3 or aligning the fringes 4 according to another possible embodiment. The carpet 3 is here divided into two halves in relation to the travel route 14, which each have an edge area 7 with fringes 4. According to this travel route 14, the floor processing device 1 in approximately a middle region moves up onto the carpet 3, and from there to different sections of the edge area 7 having the fringes.

Figure 4:
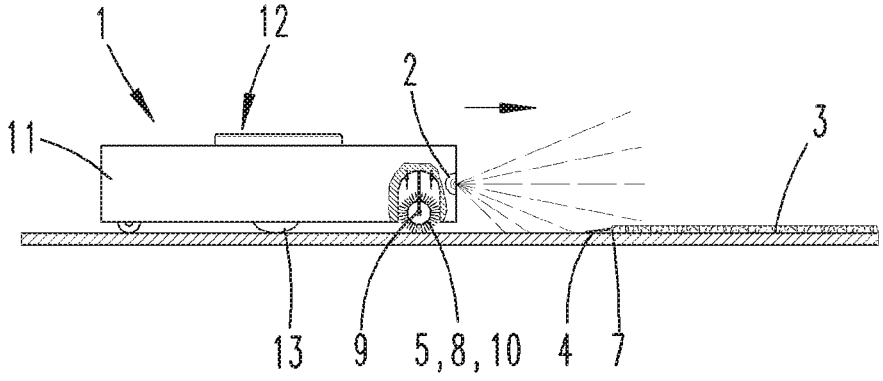
FIG. 4 is a floor processing device according to a first embodiment while approaching a carpet.
Figure 5:
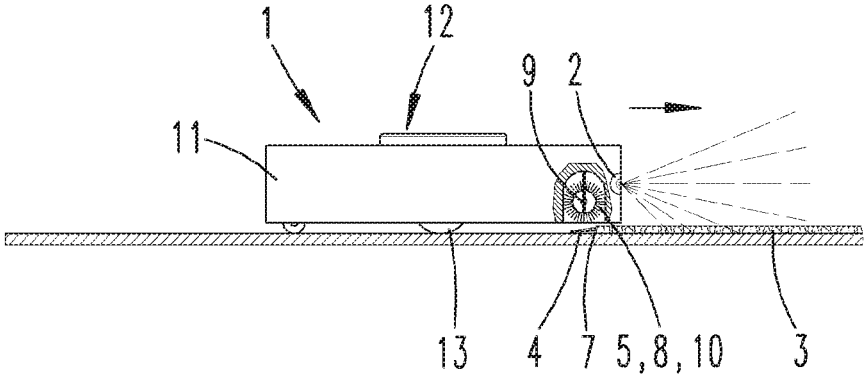
FIG. 5 is the floor processing device while moving up onto the carpet.
Figure 6:
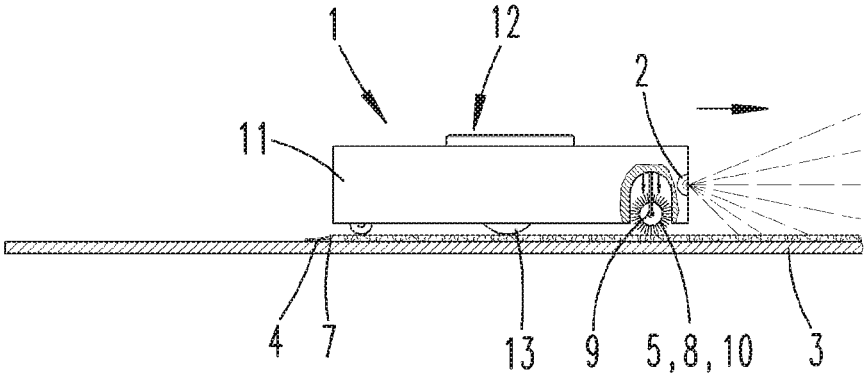
FIG. 6 is the floor processing device on the carpet.

FIGS. 4 to 6 show a floor processing device 1 as it moves up onto a carpet 3 over an edge area 7 having fringes 4. This embodiment is especially suitable for floor processing devices 1 in which the bristle roller 8 can only rotate in one direction around the rotational axis 9. In order not to disarrange fringes 4 that had previously already been aligned while moving up onto the carpet 3, the rotational axis 9 of the bristle roller 8 can be displaced relative to the housing 11. In response to a command from the controller and evaluator of the floor processing device 1, the rotational axis 9 can lifted from or lowered onto a surface to be cleaned. As depicted on FIG. 4, the bristle roller 8 is still set up on the floor to be cleaned outside of the carpet 3, and can perform an additional cleaning step while the floor processing device 1 is vacuuming, in particular loosen dust and dirt from the surface. As soon as the carpet 3 comes into the detection range of the detection system 2, the controller and evaluator of the floor processing device 1 allocated to the detection system 2 detect the carpet 3 or fringes 4 within the recorded image, and causes the bristle roller 8 to be lifted from the surface to be cleaned, so that the bristle roller 8 does not touch the fringes 4 as the floor processing device 1 moves up onto the carpet. This state is shown on FIG. 5. As soon as the floor processing device 1 has reached an area on the carpet 3 where there are no fringes 4, the bristle roller 8 can again be lowered onto the carpet 3, so as to there help clean the carpet 3. The floor processing device 1 can thereupon exit the carpet 3 on the opposite (not shown on FIGS. 4 to 6) side once more, wherein the bristle roller 8 can now remain in the lowered position depicted on FIG. 6, for example, if the rotational direction of the bristle roller 8 corresponds to the desired combing direction of the fringes 4.

Figure 7:
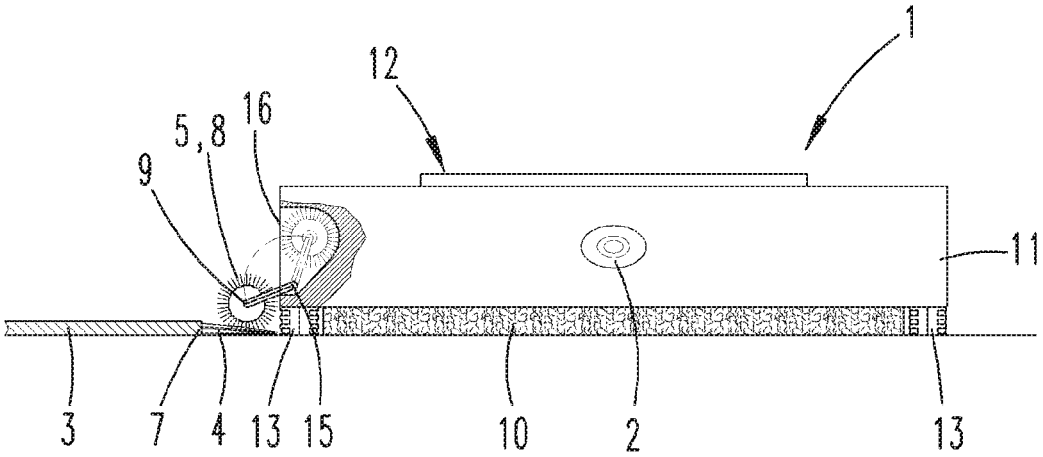
FIG. 7 is a floor processing device according to a second embodiment while aligning fringes.
Figure 8:
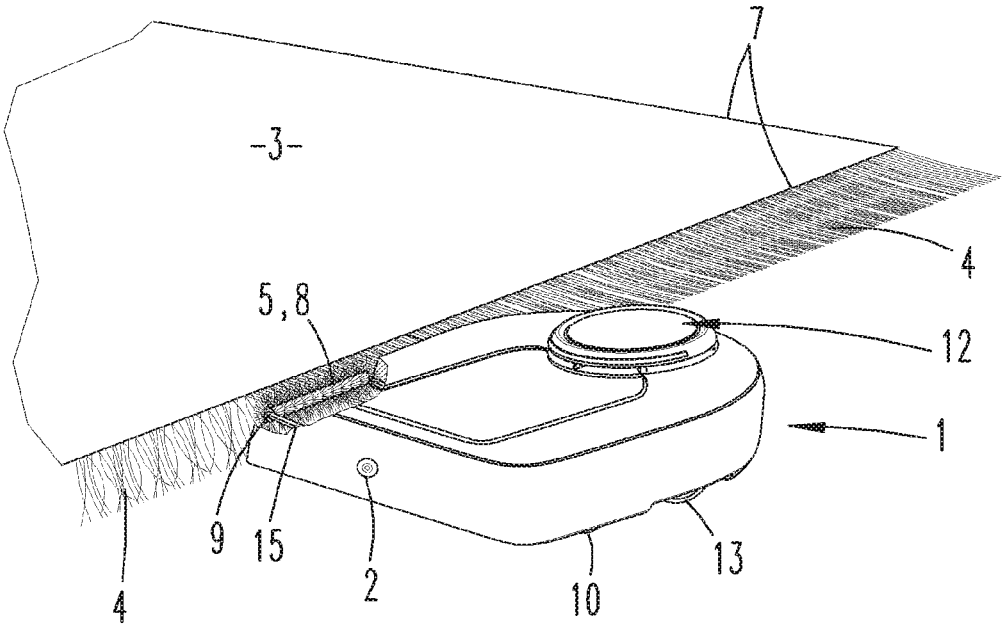
FIG. 8 is a perspective view on the floor processing device according to FIG. 7.

FIGS. 7 and 8 show another embodiment of a floor processing device 1. The floor processing device 1 here has a combing attachment 5 that can be displaced relative to the housing 11, and is a bristle roller 8. The bristle roller 8 can be swiveled out of the housing 11 and into the housing 11 around a swivel axis 15, so that the combing attachment 5 can be swiveled out of the housing 1 when needed. When not in use, the bristle roller 8 can be swiveled into a corresponding receiving area 16 of the housing 11, so that the outer dimensions of the floor processing device 1 do not change, and the floor processing device 1 can pass by pieces of furniture 17 and the like as closely possible, so that cleaning is as seamless as possible. In this embodiment, the floor processing device 1 moves along the edge areas 7 of the carpet 3 that have the fringes 4, wherein the bristle roller 8 is placed on a plurality of fringes 4 section by section, and then lifted off of them again once alignment is complete. The floor processing device 1 thereupon moves in front of an adjacent edge area 7 that has fringes 4, and there as well once again lowers the rotating bristle roller 8 onto the fringes 4 so as to align them.

Figure 9:
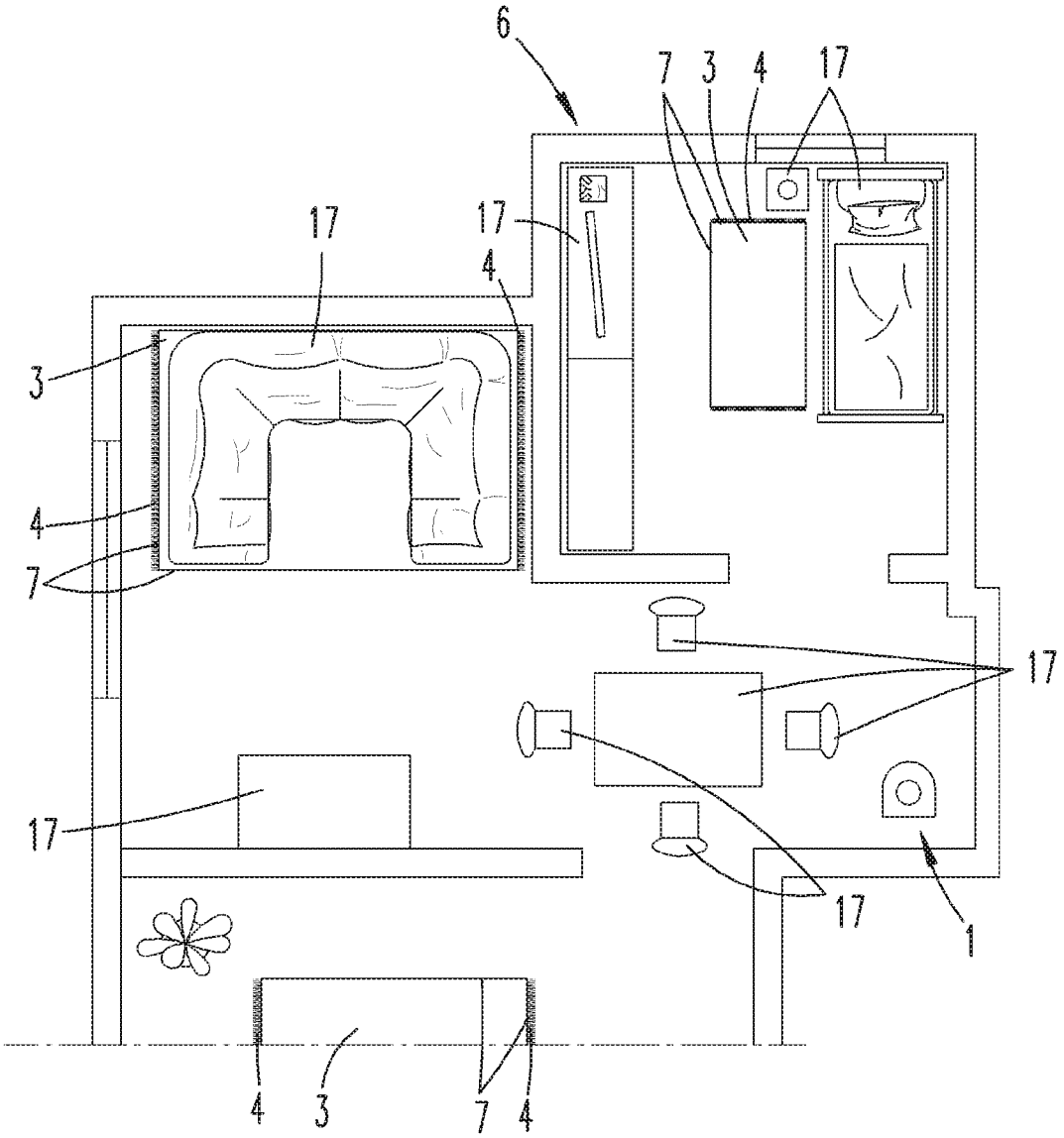
FIG. 9 is an area map of the floor processing device with carpet positions stored therein.

Finally, FIG. 9 shows an area map 6, which the floor processing device 1 generated from the distance data recorded by the distance measuring system 12 and detection system 2. The area map 6 has detected obstacles, here specifically pieces of furniture 17, room boundaries, specifically walls, and passage areas between rooms. In addition, the area map 6 has the carpets 3 detected by the detection system 2, which have edge areas 7 with fringes.

In order to generate the area map 6, the floor processing device 1 travels around the environment, here meaning the home depicted, and measures distances from obstacles, for example the shown pieces of furniture 17. At the same time, the detection system 2 detects carpets 3 present on a surface to be cleaned as well as edge areas 7 with fringes 4. The recorded data are processed into the depicted area map 6. The evaluator and controller of the floor processing device 1 can thereupon plan a travel route 14 that cleans the depicted home as advantageously as possible, wherein a cleaning sequence for rooms and/or room areas can be provided.

In an embodiment, those partial areas of the environment lying outside of carpets 3 and fringes 4 can be cleaned initially. Only during another procedural step are the surfaces of the carpets 3 then cleaned and the fringes 4 of the carpets aligned in a desired direction. The advantage to this is that already aligned fringes 4 are not again disarranged by subsequent cleaning processes. The travel route 14 further considers what orientation the carpets 3 have, and the direction in which the fringes 4 located thereon should point. As shown on FIGS. 2 and 3, depending on any edge areas 7 with and without fringes 4, it can then be provided that the floor processing device 1 move up onto a carpet 3 over specific edge areas 7 and again leave the carpet 3 over specific edge areas 7. For example, if a carpet 3 has fringes all around, on all edge areas 7, the bristle roller 8 can be lifted for moving up onto the carpet 3 as depicted on FIGS. 4 to 6, so as not to disarrange already aligned fringes 4. Alternatively, it would also be possible to change a rotational direction of the rotational axis 9 of the bristle roller 8 in such a way that, as a combing attachment 5, it always rotates in a direction that corresponds to a desired orientation of the fringes 4.

REFERENCE LIST

1 Floor processing device
2 Detection system
3 Carpet
4 Fringes

5 Combing attachment
6 Area map
7 Edge area
8 Bristle roller
9 Rotational axis
10 Floor processing element
11 Housing
12 Distance measuring system
13 Wheel
14 Travel route
15 Swivel axis
16 Receiving area
17 Piece of furniture

What is claimed is:

1. A method for operating a floor processing device that moves automatically within an environment, comprising the following steps:

detecting with a detection system of the floor processing device features of a surface to be cleaned;

comparing the features to be cleaned with reference features of carpets, upon detection of a carpet, determining whether and where the carpet has fringes, and upon a determination of fringes in the carpet, aligning the fringes in a defined direction relative to the carpet with a combing attachment of the floor processing device.

2. The method according to claim 1, wherein, before the step of aligning the fringes of the carpet, the floor processing device initially processes an area of the environment and/or carpet that has no fringes.

3. The method according to claim 1, further comprising a step of generating a travel strategy and/or travel route of the floor processing device depending on a detected position and/or a desired orientation of the fringes on the carpet.

4. The method according to claim 1, further comprising a step of storing a position and orientation of a detected carpet and a position and/or orientation of the fringes in an area map of the floor processing device.

5. The method according to claim 1, wherein during the step of aligning the fringes, the floor processing device travels onto the carpet and leaves the carpet in a direction corresponding to a desired orientation of the fringes.

6. The method according to claim 1, wherein the floor processing device travels over an edge area of the carpet having no fringes.

7. The method according to claim 1, wherein the combing attachment comprises a bristle roller that rotates around a rotational axis aligned essentially parallel to the carpet during a floor processing operation.

8. The method according to claim 7, wherein during the step of aligning, a speed and/or rotational direction of the bristle roller is varied for combing and/or traversing the fringes.

9. The method according to claim 1, wherein the combing attachment is lifted from the surface when traversing already aligned fringes.

* * * * *